US010294078B2

(12) United States Patent
Minami et al.

(10) Patent No.: US 10,294,078 B2
(45) Date of Patent: May 21, 2019

(54) ELEVATOR CAR COMPARTMENT AND ASSEMBLY METHOD FOR SAME

(71) Applicant: MITSUBISHI ELECTRIC CORPORATION, Chiyoda-ku (JP)

(72) Inventors: Masayuki Minami, Inazawa (JP); Taiji Sawaki, Chiyoda-ku (JP); Hisashi Okabe, Chiyoda-ku (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 207 days.

(21) Appl. No.: 15/319,442

(22) PCT Filed: Jul. 9, 2014

(86) PCT No.: PCT/JP2014/068327

§ 371 (c)(1),
(2) Date: Dec. 16, 2016

(87) PCT Pub. No.: WO2016/006063

PCT Pub. Date: Jan. 14, 2016

(65) Prior Publication Data

US 2017/0144863 A1 May 25, 2017

(51) Int. Cl.
*B66B 11/02* (2006.01)

(52) U.S. Cl.
CPC ..... *B66B 11/0253* (2013.01); *B66B 11/0226* (2013.01)

(58) Field of Classification Search
CPC ..... B66B 11/0253; B66B 11/0226
See application file for complete search history.

(56) References Cited

U.S. PATENT DOCUMENTS 1,429,194 A * 9/1922 Disbro ..... B66B 11/0253 52/777
1,687,087 A * 10/1928 Farch ..... B66B 11/0253 52/311.2
1,857,913 A * 5/1932 Judelson ..... E04H 1/14 52/262
1,872,007 A * 8/1932 Reilly ..... B66B 11/024 454/68
2,614,664 A * 10/1952 Sherron ..... E04H 1/14 52/262

(Continued)

FOREIGN PATENT DOCUMENTS

EP 0 997 424 A1 5/2000
JP 60-48879 A 3/1985

(Continued)

OTHER PUBLICATIONS

International Search Report dated Oct. 7, 2014 in PCT/JP2014/068327 filed Jul. 9, 2014.

*Primary Examiner* — Michael A Riegelman
(74) *Attorney, Agent, or Firm* — Xsensus LLP

(57) ABSTRACT

In a car compartment of an elevator, a standing end section of a panel is fixed to a standing section of a car floor by a screw member which is fastened by being passed through a ventilation hole and a car floor fastening hole from the car floor side, and therefore an operator can assemble the panel on the car floor from the inside of the car compartment, and the workability of assembling the panel on the car floor is improved.

11 Claims, 6 Drawing Sheets

(56) References Cited

U.S. PATENT DOCUMENTS 2,648,409 A * 8/1953 Daugherty ..... A47K 3/284 52/264
3,550,340 A * 12/1970 Klein ..... E04F 13/08 52/312
3,675,379 A * 7/1972 Lambert ..... E04B 1/08 52/264
3,731,956 A * 5/1973 Hanley ..... B65D 9/12 217/13
4,199,907 A * 4/1980 Bains ..... B66B 11/0253 52/122.1
4,251,969 A * 2/1981 Bains ..... B66B 11/0253 52/584.1
4,266,386 A * 5/1981 Bains ..... E04B 1/6116 52/481.2
4,357,993 A * 11/1982 Halpern ..... B66B 11/0253 187/401
4,430,835 A * 2/1984 Ericson ..... B66B 11/0253 24/306
4,430,838 A * 2/1984 Bains ..... B66B 11/0253 52/584.1
4,462,193 A * 7/1984 Ericson ..... B66B 11/0253 24/306
5,725,201 A * 3/1998 Parth ..... E04C 2/20 160/235
5,842,545 A * 12/1998 Blaiotta ..... B66B 11/0253 187/401
5,975,249 A * 11/1999 Tomaseti ..... B66B 11/0226 187/401
6,082,501 A * 7/2000 Lehmann ..... B66B 11/0253 187/401
6,834,468 B1 * 12/2004 Kroie ..... B32B 15/12 52/309.9
9,284,159 B2 * 3/2016 Koskelainen ..... B66B 5/027
2004/0195049 A1 * 10/2004 Stobo ..... B66B 11/0253 187/401
2007/0181383 A1 * 8/2007 Bizarria Santos .. B66B 11/0253 187/401
2007/0251409 A1 * 11/2007 Sittler ..... B66B 11/0253 105/463.1
2008/0127577 A1 * 6/2008 Elmiger ..... B66B 11/0253 52/30
2009/0200118 A1 * 8/2009 Minami ..... B66B 11/0253 187/401
2011/0100763 A1 * 5/2011 Wiacek ..... B66B 11/0253 187/401
2014/0231183 A1 * 8/2014 Halonen ..... B66B 11/0226 187/334
2014/0305749 A1 * 10/2014 Manner ..... B66B 11/0226 187/401
2015/0175388 A1 * 6/2015 Klappholz ..... B66B 11/0226 187/401
2017/0144863 A1 * 5/2017 Minami ..... B66B 11/0226
2018/0037440 A1 * 2/2018 Blondel ..... B66B 11/0233
2018/0050885 A1 * 2/2018 Fernandez ..... B66B 11/0233
2018/0208437 A1 * 7/2018 Durand ..... B66B 11/0233

FOREIGN PATENT DOCUMENTS

JP 8-310773 A 11/1996
JP 2000-255943 A 9/2000
JP 2002-46963 A 2/2002

* cited by examiner

ELEVATOR CAR COMPARTMENT AND ASSEMBLY METHOD FOR SAME

TECHNICAL FIELD

This invention relates to a car compartment of an elevator in which the side wall is formed by fixing a plurality of panels to a peripheral edge section of a car floor, and to an assembly method for the same.

BACKGROUND ART

In the prior art, an elevator car compartment is available in which car panels having slot sections in a lower end portion are moved downwards and the slot sections are abutted against bolts provisionally fastened to side ends of a platform, and the bolts are then fastened to fix the car panels to the platform (see, for example, PTL 1).

CITATION LIST

Patent Literature

[PTL 1] Japanese Patent Application Publication No. 8-310773 (FIG. 1 and FIG. 6)

SUMMARY OF INVENTION

Technical Problem

However, in the case of this elevator car compartment, when carrying out bolt assembly work inside the car compartment, an operator must work with his or her body projecting out into the elevator shaft, and hence there is a problem in that the workability of the assembly of the car compartment is poor.

This invention seeks to resolve this problem, an object thereof being to provide a car compartment of an elevator having improved workability of assembly, and an assembly method for same, wherein panels can be assembled on the car floor from the inside of the car compartment.

Solution to Problem

The car compartment of an elevator according to this invention is a car compartment of an elevator including: a car floor in which edge sections on respective sides have standing sections standing upright; and a side wall configured from a plurality of panels of which lower end sections are fixed to the standing sections by fastening members; wherein the lower end sections each include a standing end section bent to an outside in an L shape, and an opposing surface section which opposes the standing end section; the standing end section has a fastening member clearance hole into which the fastening member is inserted loosely with a head facing the opposing surface section, and a car floor fastening hole which extends upwards from the fastening member clearance hole; the opposing surface section has a hole which opposes the car floor fastening hole; and the standing end section is fixed to the standing section by the fastening member which is fastened by being passed through the hole and the car floor fastening hole from a car floor side.

Furthermore, the assembly method for a car compartment of an elevator according to this invention is an assembly method including: a step for provisionally fastening the fastening member to the standing section of the car floor; a step for loosely inserting the fastening member clearance hole of the standing end section over the fastening member and contacting an upper-side end surface of the fastening member clearance hole against the fastening member; a step for moving the panel along the upper-side end surface, towards the adjacent panel, until the car floor fastening hole reaches a position directly over the fastening member; a step for moving the panel downwards along the car floor fastening hole and making the head of the fastening member border a hole formed in an opposing surface section which opposes the standing end section; and a step for fixing the standing end section to the standing section by fully fastening the fastening member through the car floor fastening hole.

Furthermore, the assembly method for a car compartment of an elevator according to this invention is an assembly method including: a step for provisionally fastening the fastening member to the standing section of the car floor; a step for loosely inserting the fastening member clearance hole of the standing end section over the fastening member and contacting an upper-side end surface of the fastening member clearance hole against the fastening member; a step for moving the panel along the upper-side end surface, towards the adjacent panel, until the car floor fastening hole reaches a position directly over the fastening member; a step for moving the panel downwards along the car floor fastening hole and making the head of the fastening member border a hole formed in an opposing surface section which opposes the standing end section; and a step for fixing the standing end section to the standing section by fully fastening the fastening member through the car floor fastening hole; wherein, when the fastening member contacts the upper-side end surface of the fastening member clearance hole, the projection section opposes the insertion hole section, and when the head of the fastening member borders the hole, the projection section sandwiches the first bend section via the slit section.

Advantageous Effects of Invention

According to the car compartment of an elevator according to this invention, since a standing end section is fixed to a standing section by a fastening member which is fastened from the car floor side via a hole and a car floor fastening hole, then the operator is able to carry out assembly from the inside of the car compartment, and the workability of assembling the panels on the car floor is improved.

Furthermore, according to the assembly method for a car compartment of an elevator according to the present invention, since a fastening member which is initially fastened provisionally to a standing section of the car floor is subsequently passed through a hole and a car floor fastening hole and then fully fastened, thereby fixing the standing end section to the standing section, the workability of assembling the panels on the car floor is improved.

Furthermore, according to the assembly method for a car compartment of an elevator according to this invention, when the fastening member contacts the upper-side end surface of the fastening member clearance hole, the projection section opposes the insertion hole section, and when the head of the fastening member borders the hole formed in the opposing surface section, the projection section sandwiches the first bend section via the slit section, and therefore the adjacent panels are also coupled to each other at the same time, when the standing end section of the panel is fixed to the standing section of the car floor, and the workability of assembling the side wall is improved.

DESCRIPTION OF EMBODIMENTS

First Embodiment

Figure 1:
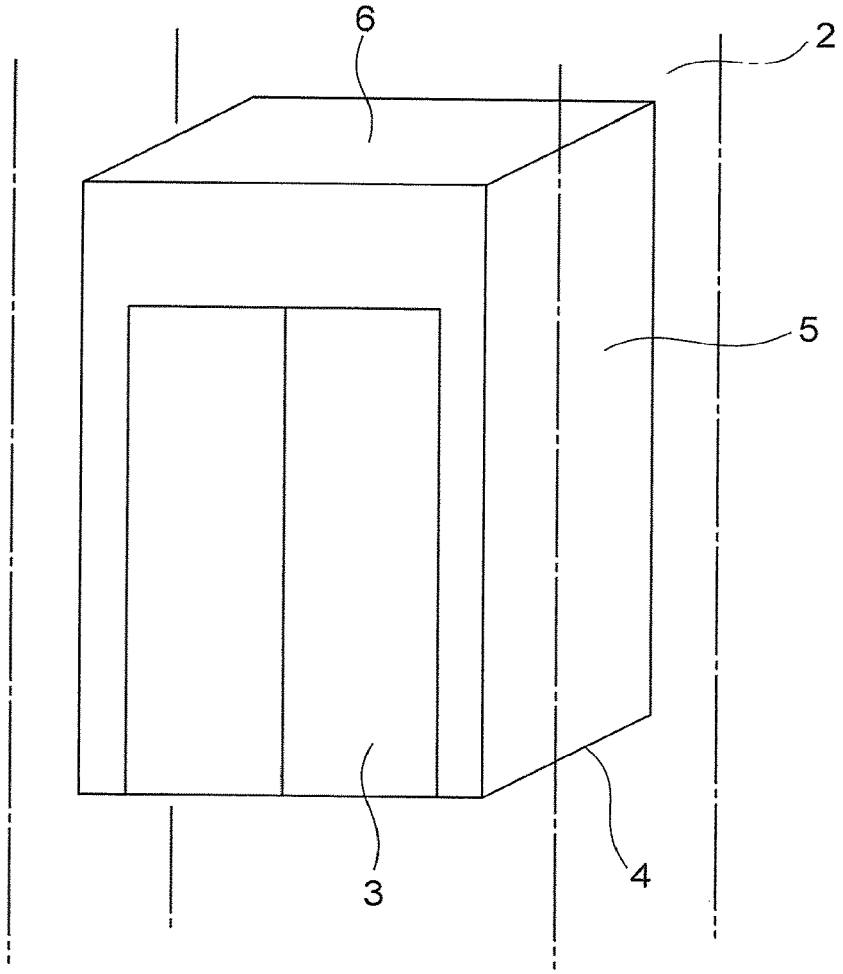
FIG. 1 is a general perspective drawing showing a car having a car compartment of an elevator according to a first embodiment of this invention.

FIG. 1 is a general perspective diagram showing a car 1 for an elevator according to a first embodiment of this invention, wherein a car which ascends and descends in an elevator shaft 2 is provided with a car door 3, which is a door of a car entrance/exit, a car floor 4, a side wall 5, and a ceiling 6.

Figure 2:
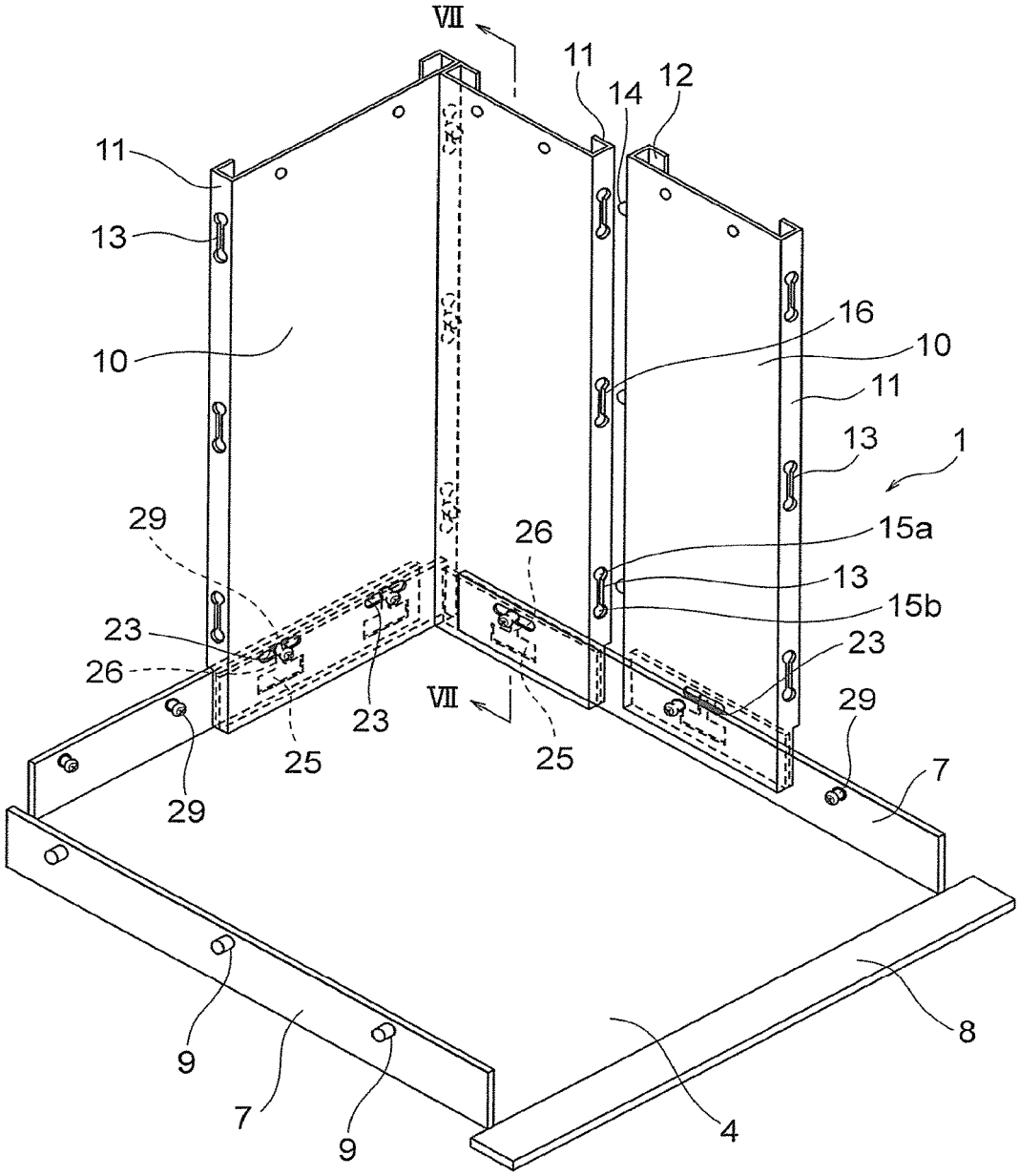
FIG. 2 is a partial perspective drawing showing a car compartment of the car in FIG. 1.

FIG. 2 is a partial perspective diagram showing a car compartment 1 of a car.

The edge portions of three edges of the car floor 4, which has a square shape, include standing sections 7 which stand in the vertical direction. A sill 8 is provided on the car door 3 side of the car floor 4. A plurality of nuts 9 are fixed on the outer side of the standing sections 7.

Figure 3:
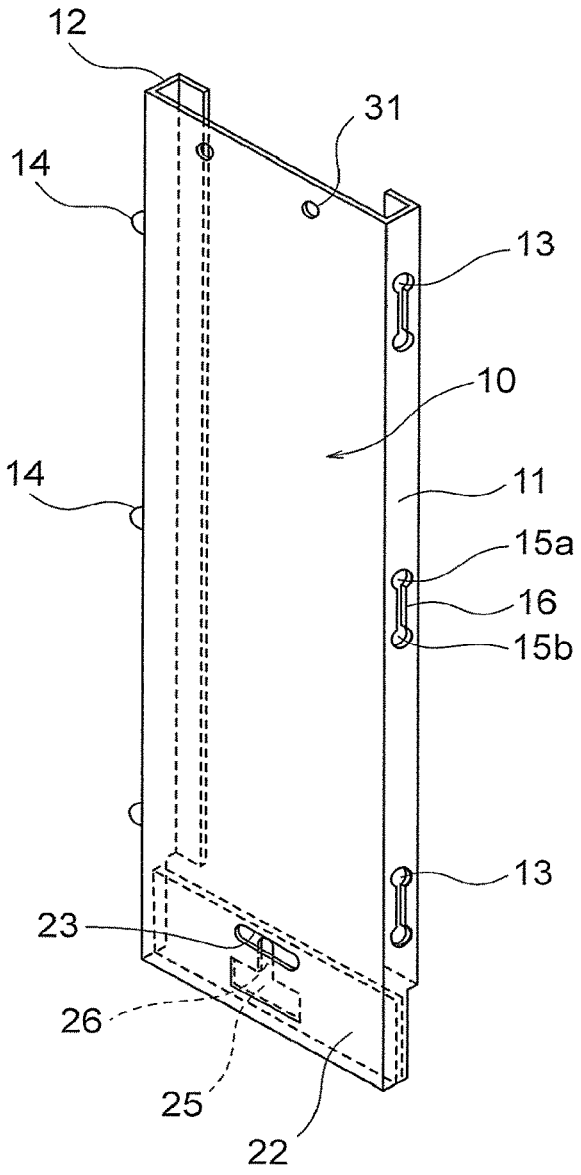
FIG. 3 is a general perspective drawing in which the panel in FIG. 2 is viewed from the inside of the car compartment.
Figure 4:
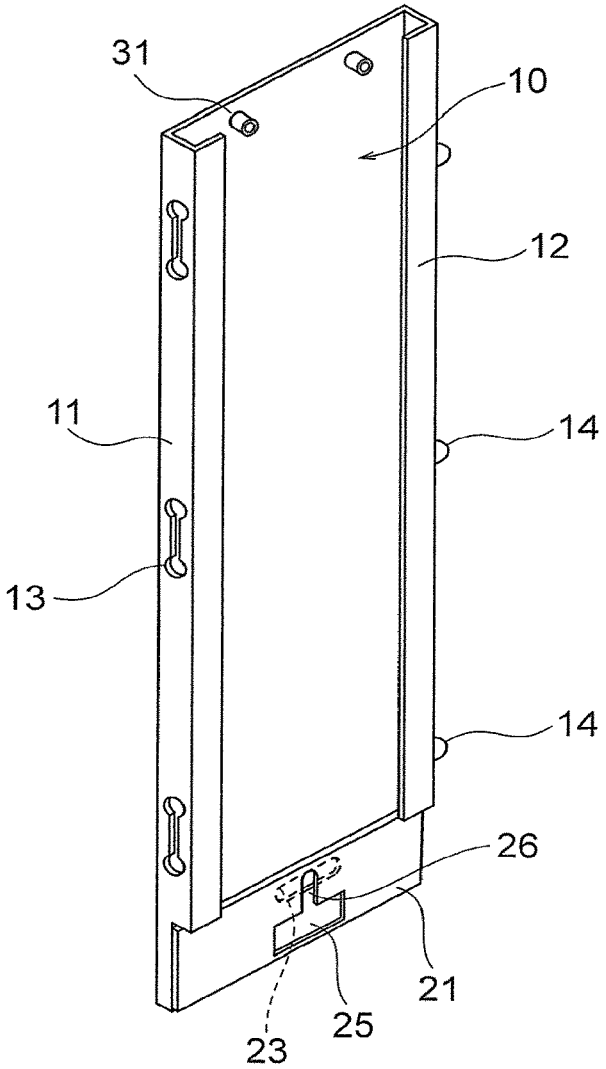
FIG. 4 is a general perspective drawing in which the panel in FIG. 2 is viewed from the outside of the car compartment.

The side wall 5 is configured from a plurality of panels 10 as shown in FIG. 3 and FIG. 4.

In each of the panels 10, a first bend section 11 and a second bend section 12 which extend in the vertical direction are formed by bending in an L shape to the outside of the car compartment.

A plurality of coupling holes 13 are formed in the first bend section 11. Coupling protrusion members 14 are provided respectively facing the coupling holes 13, in the second bend section 12.

Figure 5:
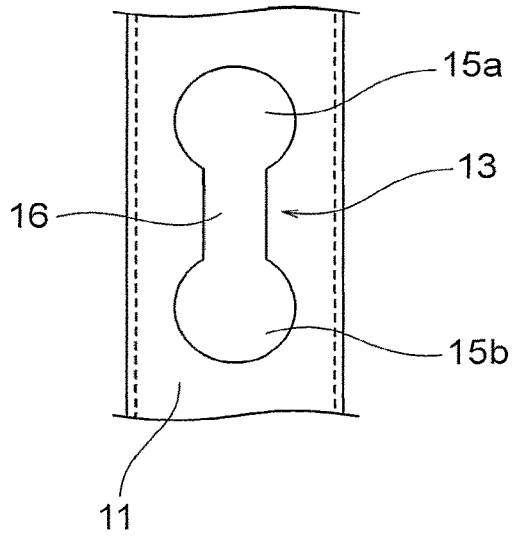
FIG. 5 is a front surface diagram showing the coupling hole in FIG. 3.

As shown in FIG. 5, each coupling hole 13 has two insertion hole sections 15*a*, 15*b*, which are mutually separated, and a slit section 16 of smaller diameter than the insertion hole sections 15*a*, 15*b*, which connects the insertion hole sections 15*a*, 15*b*.

Figure 6:
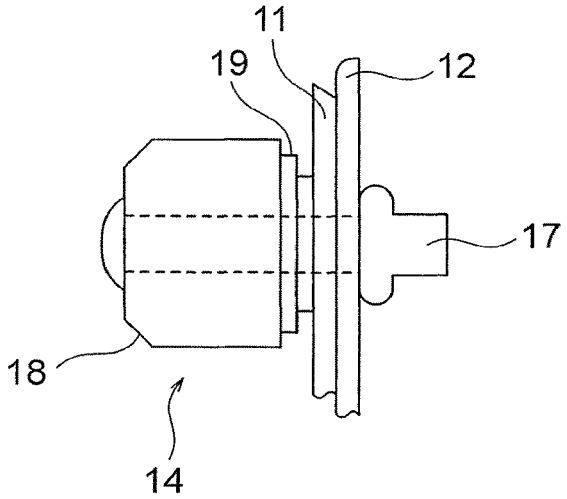
FIG. 6 is a front surface diagram showing the coupling protrusion member in FIG. 3.

FIG. 6 is a plan diagram showing a coupling protrusion member 14, and this coupling protrusion member 14 is configured by a fixed section 17 which is fixed to the second bend section 12 by caulking, and a projection section 18 which projects to the outside from the second bend section 12. The projection section 18 is smaller than the diameter of the insertion hole sections 15*a*, 15*b* of the coupling hole 13, and is larger than the width of the slit section 16. Furthermore, the projection section 18 has a step difference section 19 which is smaller than the width of the slit section 16.

Figure 7:
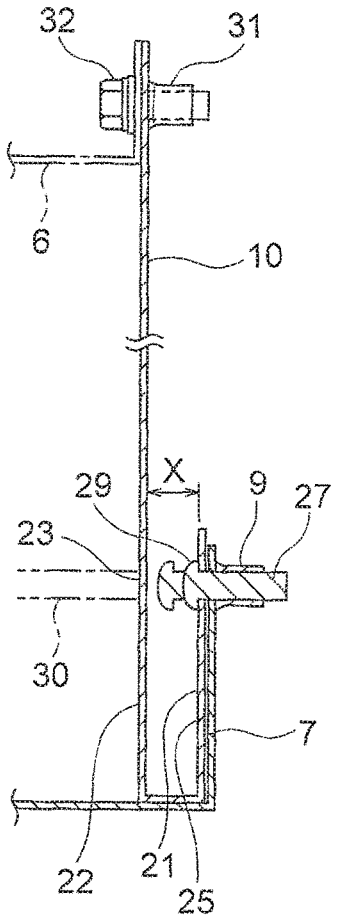
FIG. 7 is a cross-sectional diagram along line VII-VII in FIG. 2.

Furthermore, as shown in FIG. 7, a standing end section 21 which is bent in an L shape to the outer side of the car compartment 1, and an inside opposing surface section 22 which stands in parallel with the standing end section 21, are formed on the lower end section of each panel 10.

Figure 8:
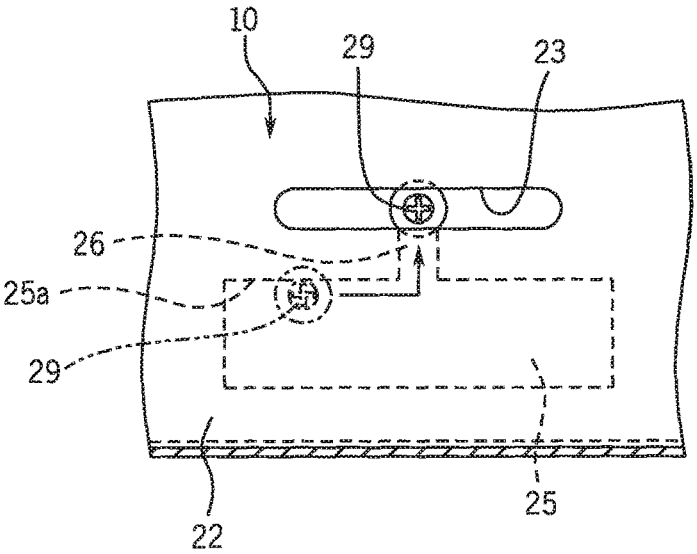
FIG. 8 is a partial front surface diagram of FIG. 7.

As shown in FIG. 8, a flat circular ventilation hole 23 is formed in the opposing surface section 22.

The standing end section 21 has a screw clearance hole 25, which is a square-shaped fastening member clearance hole, and a car floor fastening hole 26 which extends vertically upwards from an intermediate portion of the screw clearance hole 25. The front end portion of the car floor fastening hole 26 passes through the ventilation hole 23 from the car floor 4, and extends to the upper side from the ventilation hole 23 when viewed in the horizontal direction.

In the assembly of the car compartment 1, during the fixing of the panel 10 to the car floor 4, a screw 27, which is a fastening member, is provisionally fastened to the standing section 7, with a head 29 facing towards the opposing surface section 22.

When the screw 27 abuts against the upper-side end surface 25*a* of the screw clearance hole 25 during the provisional fastening of the screw 27, the projection sections 18 of the coupling protrusion members 14 oppose the insertion hole sections 15*a* of the coupling holes 13 in the adjacent panel 10.

Furthermore, when the head 29 of the screw 27 borders the ventilation hole 23 due to downward movement of the panel 10, the projection sections 18 of the coupling protrusion members 14 sandwich the first bend section 11 via the slit sections 16.

Next, in FIG. 2, a procedure is described in which a pair of panels 10 are fixed previously to the corners of the car floor 4, by using screws 27, and from this state, the panels 10 are subsequently assembled on the car floor 4.

Firstly, the screws 27 are fastened provisionally on the nuts 9 which have been fixed to the standing sections 7 of the car floor 4, with the heads 29 facing the opposing surface sections 22.

Thereupon, the screw clearance sections 25 of the panels 10 are loosely inserted over the screws 27 and the panels 10 engage with the upper-side end surfaces 25*a* of the car floor fastening holes 26. In this case, the central axis lines of the projection sections 18 of the coupling protrusion members 14 and the central axis lines of the insertion hole sections 15*a* of the coupling holes 13 of the adjacent panel 10 coincide with each other.

Subsequently, the panel 10 is moved towards the side of the adjacent panel 10, the projection sections 18 are inserted into the insertion hole sections 15*a*, and when the second bend section 12 makes surface-to-surface contact with the first bend section 11 of the adjacent panel 10, then the screw floor fastening hole 26 of panel 10 that has been moved becomes positioned directly over the screw 27.

Thereupon, the panel 10 moves downwards due to gravity, and the bottom surface of the panel 10 makes surface-to-surface contact with the upper surface of the car floor 4.

When this surface-to-surface contact occurs, the head 29 of the screw 27 borders the ventilation hole 23.

Furthermore, with the downward movement of the panel 10, the projection sections 18 of the coupling protrusion members 14 become positioned at the slit sections 16 of the coupling holes 13, and the adjacent panels 10 are thereby coupled with each other.

Thereupon, a tool 30 is inserted from the ventilation hole 23, the screw 27 which has been provisionally fastened to the nut 9 is fully fastened, and the panel 10 is thereby fixed to the car floor 4.

By successively repeating the abovementioned work from the inside of the car compartment 1, side wall 5 fixed to the car floor 4 is formed.

Finally, by coupling bolts 32 to a plurality of ceiling nuts 31 fixed to the upper side end portion of the panel 10, the ceiling 6 is fixed to the upper side end portion of the side wall 5, thereby forming the car compartment 1.

The total length of the screws 27 is longer than the distance between the standing end section 21 of the panel 10 and the opposing surface section 22 (X in FIG. 7), and the diameter dimension of the heads 29 of the screws 27 is greater than the perpendicular dimension of the ventilation hole 23.

According to the car compartment 1 for an elevator according to this embodiment, since the standing end section 21 of a panel 10 is fixed to a standing section 7 of the car floor 4 by a screw 27 which is coupled by passing through the ventilation hole 23 and car floor fastening hole 26 from the car floor 4 side, then the work of assembling the panel 10 onto the car floor 4 can be performed from inside the car compartment 1, without requiring work to be performed with the operator's body projecting out into the elevator shaft 2, and hence the workability of assembling the panels 10 is improved.

Furthermore, the first bend section 11 has insertion hole sections 15*a*, 15*b* and a coupling hole 13 including a slit section 16 of smaller width than the insertion hole sections 15*a*, 15*b* which are formed extending perpendicularly in continuous fashion from the insertion hole sections 15*a*, 15*b*, the second bend section 12 is provided with coupling protrusion members 14 each having a projection section 18 of smaller diameter than the insertion hole sections 15*a*, 15*b* and of greater diameter than the slit section 16, and the adjacent panels 10 are coupled together by means of the projection sections 18 sandwiching the first bend sections 11 via the slit sections 16.

Therefore, the adjacent panels 10 are also coupled together in a simple and reliable fashion.

Furthermore, the coupling holes 13 are each provided with insertion hole sections 15*a*, 15*b* respectively on the upper side and lower side of the slit section 16.

Consequently, when fixing a panel 10 to the car floor 4, the projection sections 18 are inserted into the upper-side insertion hole sections 15*a*, but when removing the panel 10 from the car floor 4, the panel 10 is lifted up from the car floor 4 and the projection sections 18 are removed from the lower-side insertion hole sections 15*b*, and therefore the work of coupling together, and decoupling, the adjacent panels 10 can be carried out smoothly.

Furthermore, the total length of the screws 27 is longer than the distance between the standing end section 21 of the opposing surface section 22, and when the head 29 of a screw 27 is viewed through the ventilation hole 23 in a horizontal direction from the car floor 4, then the head 29 is partially concealed.

Therefore, although it would be possible for someone, for mischievous reasons, etc., to loosen the screws 27 by using a tool 30 from inside the car compartment 1, the screws 27 can only be loosened up to the opposing surface section 22, and the screws 27 cannot be removed completely from the panels 10, and therefore it is possible to prevent mischievous removal of the screws 27. Moreover, even if the screws 27 become loose with the passage of time, the screws 27 do not become detached from the car floor 4 of the panels 10.

Furthermore, since the screw 27 which has initially been provisionally fastened on the standing section 7 of the car floor 4 is subsequently passed through the ventilation hole 23 and car floor fastening hole 26 and then fastened fully, thereby fixing the standing end section 21 to the standing section 7, then the workability of assembling the panels 10 on the car floor 4 is improved.

Furthermore, when the screw 27 contacts the upper-side end surface 25*a* of the screw clearance hole 25, the projection sections 18 oppose the insertion hole sections 15*a*, and when the head 29 of the screw 27 borders the ventilation hole 23 formed on the opposing surface section 22, the projection sections 18 sandwich the first bend section 11 via the slit sections 16, and therefore when the standing end section 21 of the panel 10 is fixed to the standing section 7 of the car floor 4, the adjacent panels 10 are also coupled together, at the same time, and hence the workability of assembling the side wall 5 is improved.

In the embodiment described above, the panels 10 are fixed to the car floor 4 by using ventilation holes 23 which connect with the outside air, but it is also possible to fix the panels 10 to the car floor 4 by using holes for another purpose which are formed in the lower part of the panels 10.

Furthermore, screws 27 were used as fastening members, but the fastening members are not limited to screws 27 and fastening members other than screws may of course be used.

REFERENCE SIGNS LIST

1 Car compartment
2 Elevator shaft
3 Car door
4 Car floor
5 Side wall
6 Ceiling
7 Standing section
8 Sill
9 Nut
10 Panel
11 First bend section
12 Second bend section
13 Coupling hole
14 Coupling protrusion member
15*a*, 15*b* Insertion hole section
16 Slit section
17 Fixed section
18 Projection section
19 Step difference section
21 Standing end section
22 Opposing surface section
23 Ventilation hole
25 Screw clearance hole (fastening member clearance hole)
25*a* Upper-side end surface
27 Screw
29 Head
30 Tool
31 Ceiling coupling nut
32 Bolt

The invention claimed is:

1. A car compartment of an elevator, comprising:

a car floor in which edge sections on respective sides include standing sections standing upright; and a side wall including a plurality of panels each including a lower end section fixed to one of the standing sections by a fastener;

wherein the lower end sections each include a standing end section, and an opposing surface section which is closer to an interior of the car than the standing end section and which is connected to and opposes the standing end section;

the standing end section includes a fastener clearance hole to receive the fastener which is oriented such that a head of the fastener faces the opposing surface section, and the standing end section further includes a car floor fastening hole which extends upwardly from the fastener clearance hole;

the opposing surface section includes a hole which opposes the car floor fastening hole;

the standing end section is fixed to the corresponding standing section by the fastener;

the hole of the opposing surface section is configured to receive a tool from the car floor side such that the tool is insertable through the hole of the opposing surface section and is engageable to tighten the head of the fastener to secure the lower end section of the sidewall to the corresponding standing section of the floor; and the head of the fastener is larger than the hole of the opposing surface section of the lower end section of the sidewall.

2. The car compartment of an elevator according to claim 1, wherein the panels each includes a first bend section and a second bend section which extend vertically on either side of the panel and are perpendicular to a face of the panel;

the first bend section includes a coupling hole including an insertion hole section and a slit section which is formed extending perpendicularly in a continuous fashion from the insertion hole section and includes a smaller width than a diameter of the insertion hole section;

a coupling protrusion having a projection section of smaller diameter than the diameter of the insertion hole section and of larger diameter than the slit section is provided in the second bend section; and the adjacent panels are coupled to each other by the projection section sandwiching the first bend section via the slit section.

3. The car compartment of an elevator according to claim 2, wherein the insertion hole section is provided on an upper side and a lower side of the slit section, in the coupling hole.

4. An assembly method for an elevator car compartment, for assembling the car compartment of an elevator according to claim 2, the method comprising:

provisionally fastening the fastener to the standing section of the car floor;

inserting the fastening member clearance hole of the standing end section over e fastener and contacting an upper-side end surface of the fastener clearance hole against the fastener;

moving the panel along the upper-side end surface, towards the adjacent panel, until the car floor fastening hole reaches a position directly over the fastener;

moving the panel downwards along the car floor fastening hole and making the head of the fastener border the hole; and fixing the standing end section to the standing section by fully fastening the fastener by inserting the tool from the car floor side through the hole of the opposing surface section and tightening the head of the fastener to secure the lower end section of the sidewall to the standing section of the floor wherein, when the fastener contacts the upper-side end surface of the fastener clearance hole, the projection section opposes the insertion hole section, and when the head of the fastener borders the hole, the projection section sandwiches the first bend section via the slit section.

5. The car compartment of an elevator according to claim 2, wherein the projection section has a step difference section.

6. The car compartment of an elevator according to claim 5, wherein the insertion hole section is provided on an upper side and a lower side of the slit section, in the coupling hole.

7. The car compartment of an elevator according to claim 1, wherein a length of the fastener is greater than a distance between the standing end section and the opposing surface section, and when the head of the fastener is viewed in a horizontal direction through the hole from the car floor, the head is partially concealed.

8. The car compartment of an elevator according to claim 1, wherein the hole of the opposing surface section is a circular ventilation hole which communicates with an outside air, and the hole of the opposing surface section is open when the fastener is tightened.

9. An assembly method for an elevator czar compartment; for assembling the car compartment of an elevator according to claim 1, the method comprising:

provisionally fastening the fastener to the standing section of the car floor;

inserting the fastener clearance hole of the standing end section over the fastener and contacting an upper-side end surface of the fastener clearance hole against the fastener;

moving the panel along the upper-side end surface, towards the adjacent panel, until the car floor fastening hole reaches a position directly over the fastener;

moving the panel downwards along the car floor fastening hole and making the head of the fastener border the hole; and fixing the standing end section to the standing section by fully fastening the fastener by inserting the tool from the car floor side through the hole of the opposing surface section and tightening the head of the fastener to secure the lower end section of the sidewall to the standing section of the floor.

10. The car compartment according to claim 1, wherein:

a diameter of the head of the fastener is larger than a smallest dimension of the hole of the opposing surface section.

11. A car compartment of an elevator, comprising:

a car floor including a main floor section and an edge section that includes a standing section that extends perpendicular to the main floor section;

a side wall including a panel that includes a lower end section configured to be fixed to the standing section by a fastener;

the lower end section includes a standing end section and an opposing surface section spaced apart from the standing end section;

the standing end section includes a fastener clearance hole to receive the fastener and a car floor fastening hole that extends above the fastener clearance hole;

the opposing surface section includes a hole that partially overlaps the car floor fastening hole in a horizontal direction;

the standing end section is configured to be attached to the standing section by the fastener;

the hole of the opposing surface section is configured to receive a tool from m a car floor side to tighten a head of the fastener to attach the lower end section of the sidewall to the standing section of the car floor; and when the lower end section of the sidewall is attached to the standing section of the car floor, the head of the fastener is at least partially overlapped in the horizontal direction by the opposing surface section.

* * * * *